US006381440B1

(12) United States Patent
Böck et al.

(10) Patent No.: US 6,381,440 B1
(45) Date of Patent: Apr. 30, 2002

(54) PRINTING SYSTEM HAVING AT LEAST THREE PRINTER DEVICES AS WELL AS METHOD FOR THE OPERATION OF SUCH A PRINTING SYSTEM

(75) Inventors: Heinz Böck, Taufkirchen; Heinrich Lay, Töging am Inn, both of (DE); Michael Kurz, Delray Beach, FL (US)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/697,431

(22) Filed: Oct. 26, 2000

(51) Int. Cl.[7] ..... G03G 15/00
(52) U.S. Cl. ..... 399/384; 399/361; 399/364
(58) Field of Search ..... 399/384, 364, 399/361, 1, 6, 194, 394, 309

(56) References Cited

U.S. PATENT DOCUMENTS

| | | | | |
|---|---|---|---|---|
| 4,609,279 A | | 9/1986 | Hausmann et al. | 399/322 |
| 4,774,524 A | | 9/1988 | Warbus et al. | 346/44 |
| 5,179,417 A | | 1/1993 | Sugaya et al. | 399/361 |
| 5,963,770 A | * | 10/1999 | Eakin | 399/364 |
| 6,101,364 A | * | 8/2000 | Boehmer et al. | 399/361 |

FOREIGN PATENT DOCUMENTS

| | | |
|---|---|---|
| WO | WO 92/15513 | 9/1992 |
| WO | WO 98/43136 | 10/1998 |
| WO | WO 99/24877 | 5/1999 |
| WO | WO 00/10121 | 2/2000 |

* cited by examiner

*Primary Examiner*—Sophia S. Chen
(74) *Attorney, Agent, or Firm*—Schiff Hardin & Waite

(57) ABSTRACT

A triplex printing system has three electrographic printer devices which enables both-sided, exactly registered printing of a paper web. For this purpose, the front side is printed in a first printer, the backside is printed in a second printer and the backside is printed again superimposed in a third printer. As a result of the arrangement of two printer chains having six printers, the structuring of a variable printing system adjustable dependent on function having a plurality of printer lanes is possible.

16 Claims, 2 Drawing Sheets

PRINTING SYSTEM HAVING AT LEAST THREE PRINTER DEVICES AS WELL AS METHOD FOR THE OPERATION OF SUCH A PRINTING SYSTEM

BACKGROUND OF THE INVENTION

For both-sided or multi-color printing of a web-shaped recording medium with toner images, U.S. Pat. No. 4,609,279 discloses that two printer devices be coupled via a turnover station with which the recording medium is turned over in a duplex mode or multi-color printing is performed on one side without turnover given a superimposed mode. A chemically acting cold fixing station is thereby employed as a fixing station for fixing the toner images on the recording medium.

The both-sided or single-side multi-color printing of the recording medium with two printer devices is significantly more problematical when these respectively comprise a thermal pressure fixing unit as disclosed, for example, by U.S. Pat. No. 5,179,417. One must thereby see to it that the fixing unit of the printer device arranged downstream does not heat the first toner image, which has already been fixed, to such an extent that it smears.

Another problem that has arisen when fixing with pressure and heat is the paper stress that occurs and the shrinkage of the paper connected therewith. Paper contains up to 10 weight percent water that evaporates given heating and thereby allows the paper to shrink, namely up to 2 mm in width given an A3 format. As long as the paper is printed on both sides, this is insignificant since a slight registration offset from the front side to the back side of the toner image is not disturbing. When a web-shaped recording medium is multiply printed on one side with the assistance of two printer devices without turnover and is thereby thermally fixed, the registration offset is extremely disturbing, particularly in what is referred to as a spot color mode.

A black toner image is thereby applied with a first printer and a chromatic toner image is then superimposed on this toner image with a second printer. By employing toner that can already be fixed at low temperatures, an attempt has been made to alleviate the paper stress and, thus, to enhance the registration precision. This, however, is cost-intensive and requires an exact regulation, especially in view of the fixing station.

For achieving high printing outputs with electrographic printer devices of 1,000 pages/minute and more, particularly for individualized mass printed matter like bills, brochures, etc., it is standard to print a paper web and to cut, sort and bind this with the assistance of a following post-processing unit. Single printers or—for the duplex or spot color mode—two coupled printers were previously utilized for this purpose. Printer parks with a plurality of printers are thereby employed for handling high print volumes. These printer parks must be very flexibly designed with short conversion times in order to achieve a high usage degree.

Precisely in mass printing, it is increasingly necessary to employ an additional color for company logos or for emphasizing defined text parts, for example in invoices, in addition to monochromatic black-and-white printing. What is desired in invoice printing, for example, is a two-color printing on the front side with emphasis of the amount of the invoice in color and the explanations in black-and-white and, for example, instructions about legal recourse in black-and-white on the back side. Such print jobs have previously been handled in that two-color printing was first carried out on the front side with a color twin (two coupled printers) and this was rolled up on a take-up roller. The print job was subsequently resupplied to a single printer and the back side printer therewith. This is involved and leads to considerable problems in adhering to the registration precision.

SUMMARY OF THE INVENTION

It is therefore a goal of the invention to offer a printing system composed of a plurality of electrographic printer units that are coupled or can be coupled to one another that can be flexibly and quickly adapted to the greatest variety of print jobs.

Another goal of the invention is to design the printing system such that a web-shaped recording medium can be printed in multi-color fashion on the front side and at least single-color on the backside in one pass.

According to the method and apparatus of the invention, a method and system is provided for registered printing of a web-shaped recording medium with a plurality of functionally coupled, electrographic printer devices in a triplex arrangement. A front side of the recording medium is printed with a front side toner image in a first color and subsequent fixing is provided in a thermal fixing station with a first printer device. The printed recording medium is turned over in a turnover station. A backside of the web-shaped recording medium is printed with a backside toner image in one of a first and a second color and subsequently fixed in a thermal fixing station with a second printer device that accepts the turned over recording medium. The backside is additionally printed with an additional toner image and a color deviating from the backside toner image and subsequent fixing is provided in a fixing station with a third printer device.

The construction of a printer park that can be converted and flexibly adapted to the greatest variety of printing jobs is possible with the disclosed, variable triplex arrangement of printer chains having three serially coupled printer devices.

Surprisingly, multi-color printing on the front side with simultaneous single-color backside printing is also possible upon employment of printers having a thermal fixing when, in conformity with the invention, the backside is first printed in one color with the first printer device, is thermally fixed and turned over, the front side is then printed with toner of a first color with the following, second printer device, is thermally fixed, and the front side is then printed again with toner of a second color with the third printing device.

It has been shown that any percent of the maximum paper shrinkage already occurs in the initial thermal fixing. The further thermal fixing in the second printer causes no significant additional shrinkage. Nearly no registration offset between the toner images of the second and third printer thus occurs given the two-time printing of the front side. An additional registration control can further enhance the registration precision.

In order to alleviate the paper stress, it is advantageous to moisten the paper after the thermal fixing. The electrical charge behavior can thus also be governed better.

Embodiments of the invention are shown in the drawings and shall be explained in greater detail below by way of example.

DESCRIPTION OF THE PREFERRED EMBODIMENTS

Electrographic printers refer, among other things, to printer devices working according to the electrophotographic, the magneto-graphic or ionographic printing principle or are even referred to in jet printers wherein a recording medium is printed with a medium and is fixed in a fixing station upon application of heat. The front side and the back side are purely relative particulars with respect to the axis of the recording medium and are thus interchangeable in view of the absolute physical position and their logical utilization.

Figure 1:
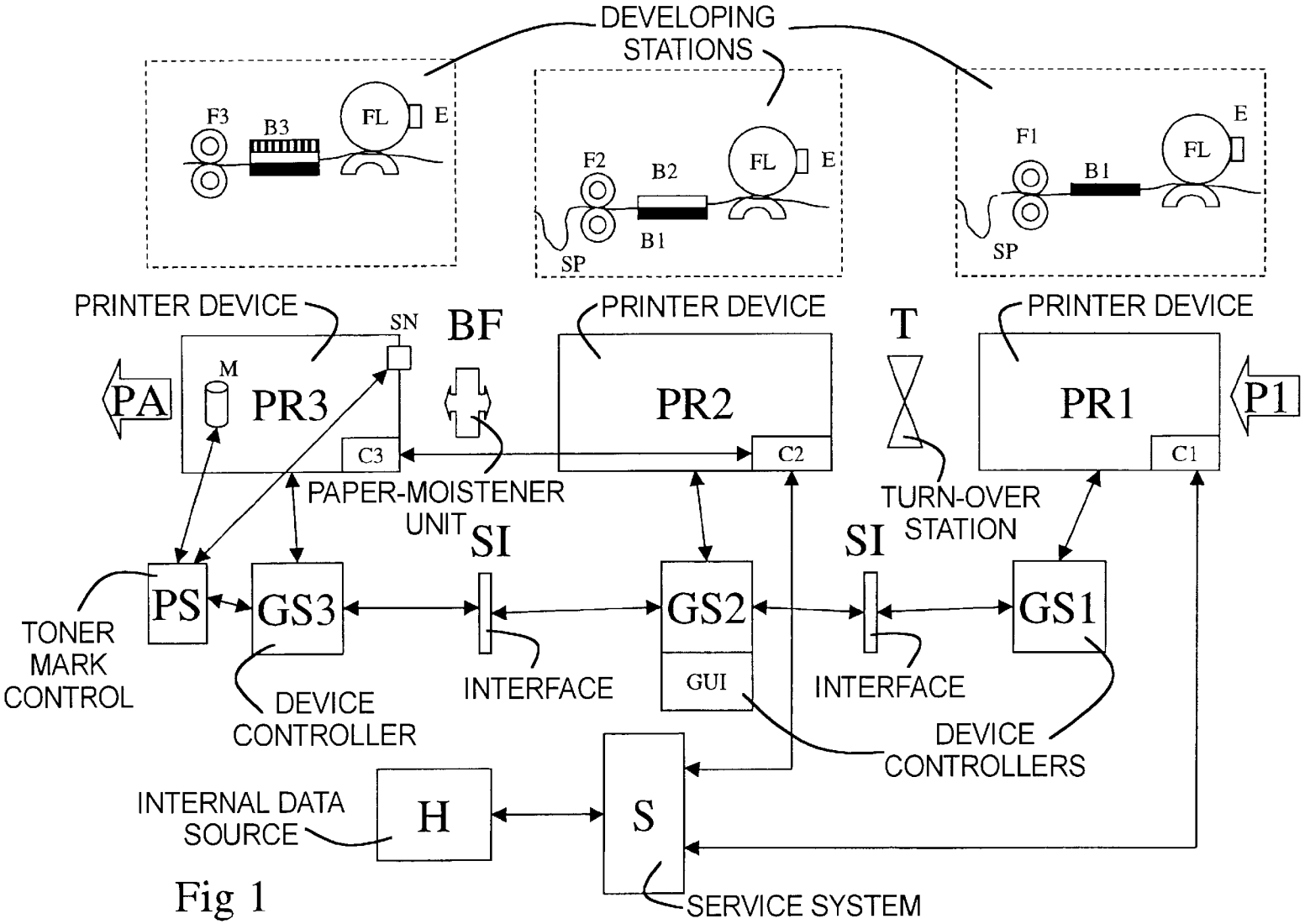
FIG. 1 is a schematic illustration of a triplex arrangement of three electrographic printers.

The triplex printer arrangement shown in FIG. 1 contains three serially arranged, electrographic printer devices PR1, PR2 and PR3, as disclosed, for example, by U.S. Pat. No. 5,179,419 or U.S. Pat. No. 4,609,279. Given these printer devices, a latent charge image is generated on a photoconductor FL with the assistance of a character generator (LED, laser, magneto-graphically, etc.), is developed with toner in a developing station (E) comprising toner reservoirs for accepting the greatest variety of toners, and the toner image is then transferred onto a recording medium, for example, paper, in a transfer station. The loose toner image is then fixed with the influence of heat and pressure given the assistance of a fixing station $F_1$, $F_2$, $F_3$. Each of the printer devices PR1, PR2, and PR3 contains a program-controlled device controller GS1, GS2, GS3 for the control of the printer-associated units which is composed of principal module and sub-modules that collaborates with a controller C1, C2, C3 via which data are supplied to the respective printer and, for example, are converted into drive signals for the character generator. The data derive from an external and/or internal data source H. They are converted by a service system S into printer data having a specific printer format (pdf, etc.) and are then supplied to the printer controllers C1, C2, C3. The structure of the controller is disclosed, for example, by U.S. Pat. No. 4,774,524, which is incorporated into the specification by reference. In the illustrated triplex arrangement for both-side printing of a web-shaped recording medium P1 with differently colored toner images with the assistance of three printers, the control of the system occurs via the principal modules of the device controller GS1, GS2, GS3. In particular, the principal module of the device controller GS2 of the printer PR2 plays a leading part. On the one hand, it assumes the control of the print start of the three different printers PR1, PR2, PR3 on the basis of the software controlled enable of a data write enable signal; on the other hand, it serves as a data communicator for information that are to be sent from printer PR1 to printer PR3 or for data from printer PR3 to printer PR1. For this purpose, printer PR2 is connected to printer PR3 via the one serial interface SI (for example, designed as a known HSCX RF interface), and printer PR2 is likewise connected to printer PR1 via a serial interface SI (for example, likewise designed as a HSCX interface, referred to as a triplex interface). Printer PR1 has no direct connection to printer PR3 in the illustrated application. Settings that are the same at all three printers such as, for example, paper length, paper width . . . , are forwarded from the principal module GS2 to the respective other printers. The operator can input specific settings via a control panel GUI (Universal Graphic Interface) coupled to the principal module GS2, for example in the form of a touch screen picture screen. The printer devices PR1, PR2, PR3 can each comprise a control panel. In this case, the control panels are linked to the device controller of the printers such that the operation of the printer devices can occur proceeding from each control panel.

Each of the printer devices also comprises a toner mark control PS (registration control) as part of the device controller GS. The toner mark control PS in the printer PR3 is thereby shown. It contains a toner mark sensor SN that senses a toner mark applied to the recording medium P1 by the printer PR2 arranged upstream and converts this into a toner mark signal. The toner mark, however, can also be designed as a print mark that has already been pre-printed and that, for example, is arranged at the edge of the paper web. Dependent on its position, a recording medium transport unit M (motor, tractor) in the printer is driven. This toner mark control is disclosed in greater detail in WO 00/10121, International Serial No. PCT/EP99/05940, which is incorporated into the specification by reference.

A turnover station that, for example, can be designed in conformity with the turnover station shown in U.S. Pat. No. 4,609,279 (incorporated by reference), is also located between the first and second printer device PR1, PR2. Buffer stores SP for the recording medium P1 are arranged between the printer devices PR1, PR2, PR3. They can be designed as sagging loops or as a mechanical loop-drawing unit. It is likewise possible to arrange a paper-moistening unit BF in the transport path of the paper web P1 between the printers PR1, PR2, PR3. It contains a water evaporator whose vapor acts on the paper and moistens it, and thus compensates the water loss in the paper that is arisen due to the thermal fixing or, on the other hand, conditions the paper overall as well specifically in view of its electrostatic behavior.

As already initially explained, it is increasingly necessary in conjunction precisely with mass printings to employ an additional color for company logos or for emphasizing defined parts of the text, for example in invoices, in addition to single-color black-and-white printing. What is desired in invoice printing, for example, is a two-colored print on the one side with emphasis of the amount of the invoice in color and the explanations in black-and-white, and, for example, on the other side, instructions about legal rights in black-and-white. With the printer system according to FIG. 1, this can be accomplished in a simple way in one pass.

For this purpose, the paper web P1 is first printed with a black toner image B1 in flowing text on the front side (top side) in the printer PR1 and is thermal pressure fixed in a fixing station F1. A heating of the paper up into the region of what is referred to as the transition point wherein the toner becomes soft and sticky and unites to the paper surface thereby occurs. As a result of the heating, the paper loses a significant part of its water content and it shrinks. The paper web P1 is then buffered in the loop buffer SP, is turned over in the turnover station T and is then supplied to the printer PR2 for printing the backside (underside) with a backside toner image, likewise with black toner and in flowing text. The positioning of the backside toner image is controlled, among other things, with the registration controller PS of the printer PR2 (not shown here). The toner image B2 applied via the printer PR2 is then fixed in the fixing station F2, namely together with the front side toner image that has already been fixed. Suitable techniques in the fixing station (shutdown of the pre-heating saddle, temperature control in the fixing drum, etc.) thereby see to it that the toner image B1 of the front side is not smeared. The renewed heating of the paper web P1 results therein that approximately 80% of the water content of the paper web escapes and, thus, nearly the maximum shrinkage occurs following the fixing station F2. The paper web P1 printed black on both sides is buffered in the buffer store SP and then is supplied to the printer PR3 without being turned over, the printer PR3 printing an additional toner image B3, for example printed with red toner, on the existing backside toner image B2; for example, a red company logo or underlining lines, etc., or important texts to be emphasized. The fine positioning of the additional toner image B3 occurs in the described way, among other things via the registration controller PS, whereby the drive M of the paper web P1 moves slightly relative to the photoconductor upon utilization of friction. An optimum registration precision thus derives overall. Care must be exercised in the control to see that the speed of the photoconductor FL in the transverse station with the toner image to be transferred is slightly higher than that of the tangential paper web P. What is thus achieved is that the toner particles of the toner image are pushed slightly together during transfer, this enhancing the print quality. When the speed relationships are reversed, i.e. the paper is faster, the particles drift apart during transfer, this deteriorating the visual impression of the print image.

After the additional toner image B3 has been fixed on the backside toner image B2 in the fixing station F3 of the printer PR3, the printed paper web P1 is supplied to a post-processing unit PA that, for example, cuts the paper web into individual sheets, and sorts them or positions them with correct attitude by renewed turnover.

The positioning precision and the electrostatic behavior of the paper web P1 can be potentially improved when the paper web passes through a moistening unit BF arranged between the printers.

Given another embodiment (not shown here) for printing with magnetically readable toner (magnetic ink character recognition), what is referred to as MICR toner, an MICR toner image is applied with one of the printers PR2 or PR3. It should thereby be noted that most MICR toners require a fixing temperature that is higher than the fixing temperature of toners on a polystyrol or polyester basis. The techniques that have already been described are thus necessary in order to prevent a renewed heating or smearing of the toner images that have already been fixed. For example, it is beneficial to apply the MICR toner in the printer PR2 and to fix it and to thereby protect the toner image B1 against smearing on the basis of appropriate measures (temperature control, disconnecting the pre-heating saddle, etc.), and to then superimpose a corresponding toner image on the MICR toner image. Given MICR, with an appropriately adapted transition point, an application of the MICR toner image is also possible with any of the other printer devices PR1, PR3, or PR1', PR3'.

It is also advantageous when a quickly changeable developing station E is allocated at least to the printer device that frequently is provided with different toner, whether it be color toner of different colors or MICR toner. This for example is potentially designed according to WO 99/24877 (incorporated by reference) or WO 98/43136. The type of developer station is automatically recognized by a sensor, etc., and the device controller GS is informed thereof, the latter setting the corresponding electrographic parameters (bias voltage, etc.).

Figure 2:
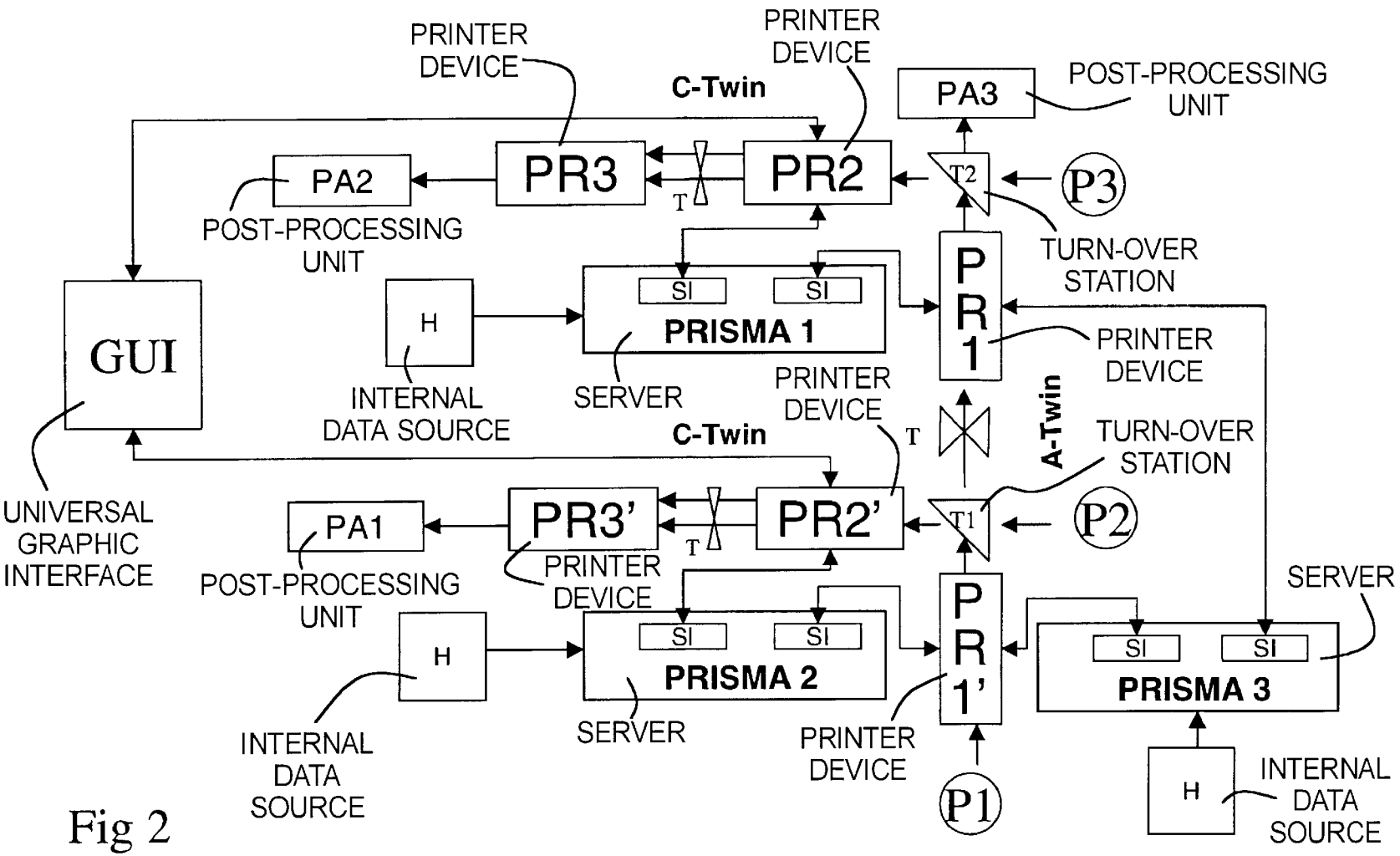
FIG. 2 is a schematic illustration of an arrangement of six electrographic printers.

Using the triplex printer arrangement described in conjunction with FIG. 1, a highly variable, multi-functional printer system composed of six individual printers can then be configured, as described in greater detail below with reference to FIG. 2.

The printing system is essentially composed of two printer chains in a triplex arrangement PR1, PR2, PR3 and PR1', PR2', PR3'. These are arranged such that, on the one hand, the first printers PR1, and PR1' are in alignment with one another in view of the transport direction of a traversing paper web P1 and, on the other hand, such that the other printers are perpendicular to this transport direction, likewise in pairs PR3, PR2; PR3' PR2', aligning with one another in view of the transport direction of a traversing paper web P3 or P2. Deflection or turnover devices T1, T2 as known, for example, from WO 92/15513 are arranged in the intersecting points of the transport directions. Dependent on function, such turnover devices are likewise arranged between the printer devices PR3, PR2; PR3', PR2'.

The printers are driven by three printer servers Prisma1, Prisma2 and Prisma3 that convert the data arriving from one or more external data sources H into print data and via interfaces SI to the printers, where they are processed in the way described in conjunction with the triplex configuration. The required device controller has been omitted from FIG. 2 for the sake of clarity. All printers are functionally connected to one another and can be operated in various functions (modes) coupled to one another dependent on function. These functions are selected via a control panel GUI (Universal Graphic Interface) and are controlled by software.

In the independent triplex mode, the two triplex arrangements PR1, PR2, PR3 and PR1', PR2' and PR3' are operated independently of one another, analogous to FIG. 1. For this purpose, the servers Prisma1 and Prisma2 convert the data received from the external data sources H into printer data and conduct them via the corresponding controller to the printers. The service Prisma3 is not functioning. Printer PR2 and printer PR3 or PR2' and PR3' form what is referred to as a C-twin, i.e. a printer arrangement according to the master-slave drive principle corresponding to the principle disclosed by U.S. Pat. No. 4,774,524 with the printer PR2 or PR2' as a master. The printers PR2 and PR1 or PR2' and PR1' work as what are referred to as A-twins with independent control. The turnover stations T1 are not functioning or are tunneled under, and the turnover stations T1 or T2 are active as a turnover unit, whereby the deflection and turning station T1 comprises, on the one hand, a turnover unit that turns the paper web P1 printed by the printer PR1' over and conducts it to the printer PR2'; on the other hand, a deflection unit that deflects the paper web P2 by 90° and conducts it to the printer PR1 for printing the front side. The deflection and turnover station T2 comprises, on the one hand, a turnover unit and, on the other hand, a deflection unit in the form of a tunnel. In the independent triplex mode, the paper web P2 printed with a front side toner image is supplied to the printer PR2 turned over.

In a duplex mode, the serially connected, first printers PR1' and PR1 are operated as an A-twin and are thereby supplied with print data via the server Prisma3. In this arrangement, the paper web P1 can be printed in two-colored fashion on both sides (each printer having a differently color toner) or in a single color (both printers have the same toner), whereby a turnover station T turns the paper web over after printing the front side for printing the backside. The station T1 is bypassed. When the turnover station T is bypassed, the paper web can, for example, be printed in two-colored fashion on a single side in a superimposition mode.

The second and third printer devices PR2 and PR3 or PR2' and PR3' are operated in a duplex mode as what are referred to as C-twins for both-sided printing of the respective recording medium P3 or P2, namely according to the described master-slave principle, whereby the deflection and turnover stations T1 and T2 are bypassed and the turnover stations T between the printers are activated. A both-sided, single-color or two-color printing is thus possible in a duplex mode or, given deactivated turnover stations T, a single-sided, two-colored superimposed printing is possible in a superimposition mode.

For both-sided, superimposed printing of a single recording medium P1 in a duplex superimposition mode, further, the two serially connected, first printer devices PR1' and PR1 of each printer chain and the serially connected second and third printer device PR2 and PR3 of the second printer chain are operated in common. The paper web P1 can thus be printed in two-colored fashion on both sides when, for example, each printer of the printer pairs PR1' and PR1 or PR3 and PR2 employ differently colored toner. Dependent on the toner fill of the developing stations of the printers, any other combination of four printers with corresponding turnover or deflection stations is also possible.

All printer chains or printer lanes can be followed by appropriate post-processing units PA1, PA2, PA3. The entire printing system can be set in a simple way by software according to the desired printer mode, being set via the control panel GUI without a hardware retrofitting being required for this purpose.

Instead of a plurality of servers Prisma1, Prisma2 and Prisma3, a central server can also be employed that switchably drives all printer devices. The device controller can also be adapted in conformity with the flexible requirements and can be modified; for example, the C-twin and A-twin drive principle can be exchanged or it is also possible to couple the printer devices to a central controller in terms of hardware.

Although various minor modifications might be suggested by those skilled in the art, it should be understood that our wish to embody within the scope of the patent warranted hereon all such modifications as reasonably and properly come with the scope of our contribution to the art.

What is claimed is:

1. A printing system for registered printing of a web-shaped recording medium with a plurality of functionally coupled, electrographic printer devices, comprising:

a first printer device for printing a front side of the recording medium with a front side toner image of a first color and subsequently fixing in a first thermal fixing station;

a turnover station accepting the printed recording medium for turning the web-shaped recording medium over;

a second printer device accepting the turned over recording medium for printing a backside of the web-shaped recording medium with a backside toner image in the first or in a second color and subsequently fixing in a second thermal fixing station; and a third printer device accepting the recording medium supplied from the second printer device for additionally printing the backside with an additional toner image in a color deviating from the color of the backside toner image, and subsequently fixing in a third thermal fixing station.

2. The printing system according to claim 1 comprising a registration control unit for substantially exactly registered synchronization of the toner images printed by the printer devices at least between the backside toner image and the additional toner image.

3. The printing system according to claim 1 whereby, for substantially exactly registered synchronization of the toner images to be printed, the printer device arranged upstream in a transport direction of the recording medium generates a synchronization mark whose position is sensed by a sensor unit of the printer device arranged downstream and is supplied as a position signal to a registration control unit that, dependent thereon, at least controls a recording medium drive of the printer device arranged downstream, whereby a loop buffer is formed between the upstream and downstream printer devices.

4. The printing system according to claim 1 comprising a moistening unit arranged between a neighboring printing device that moistens the recording medium.

5. The printing system according to claim 1 whereby at least one of the printer devices comprises a developer station that is rapidly changed dependent on a toner type being employed.

6. A method for operating a multi-functional printing system, comprising the steps of:

providing a first and a second printer chain of respectively three electrographic printer devices each designed for printing a web-shaped recording medium;

in a triplex mode, operating two printer chains as independent triplex printer chains that respectively print a separately supplied recording medium;

in a duplex mode, operating at least one of serially connected first printer devices, and second printer devices and third printer devices of the two printer chains as duplex printing systems for both-sided printing of a respective recording medium;

in a superimposition mode, operating in common the serially connected second printer devices and third printer devices of a printer chain for superimposed single-sided printing of a recording medium;

in a duplex superimposition mode for both-sided, superimposed printing of a single recording medium, operating in common the two serially connected, first printer devices, of each printer chain and the serially connected, second printer device and third printer device of the second printer chain; and in a single print mode, operating at least one of the printer devices as a single printer.

7. The method of claim 6 wherein at least one moistening unit moistens the recording medium.

8. The method according to claim 6 whereby at least one of the printer devices comprises a developer station that is rapidly changed dependent on toner type.

9. A multi-functional printing system, comprising:

a first and a second printer chain each comprising a respective first electrographic printer device, a second electrographic printer device and a third electrophotographic printer device designed for printing a web-shaped recording medium;

the two first printer devices of the first and second printer chains are arranged following one another in a first transport direction and the second printer devices and third printer devices of the first and second printer chains are respectively arranged following one another in a second transport direction that crosses the first transport direction at approximately a right angle; and at least one of a respective deflection station and turnover station is arranged in at least one of crossing regions of the transport directions and between the second and third printer devices in each of the first and second printer chains.

10. The printing system according to claim 9 having at least one moistening unit that moistens the recording medium.

11. The printing system according to claim 9 whereby at least one of the printer devices comprises a developer station that is rapidly changed dependent on toner type.

12. A method for registered printing of a web-shaped recording medium with a plurality of functionally coupled, electrographic printer devices in a triplex arrangement, comprising the steps of:

printing a front side of the recording medium with a front side toner image in a first color and subsequently fixing in a first thermal fixing station with a first printer device;

turning the printed recording medium over in a turnover station;

printing a backside of the web-shaped recording medium with a backside toner image in at least one of the first and a second color and subsequently fixing in a second thermal fixing station with a second printer device that accepts the turned over recording medium; and additionally printing the backside with an additional toner image in a color deviating from the backside toner image and subsequently fixing in a third thermal fixing station with a third printer device.

13. The method according to claim 12 whereby the recording medium is moistened following the first, second, and third thermal fixing stations.

14. The method according to claim 12 whereby a photoconductor exhibits a slightly higher speed relative to the recording medium at least during transfer of the toner images from the photoconductor onto the recording medium.

15. A method for operating a multifunctional printing system with a control system that is driven function-dependent, comprising the steps of:

selecting at least one of the following operating function;

a triplex mode wherein two printer chains are operated as independent triplex printer chains that respectively print a separately supplied recording medium;

a duplex mode wherein at least one of serially connected first printer devices, and second printer devices and third printer devices of the two printer chains are operated in common as duplex printing systems for both-sided printing of a respective single recording medium;

a superimposition mode wherein serially connected second and third printer devices of a printer chain are operated in common for superimposed, single-sided printing of a recording medium;

a duplex superimposition mode for both-sided, superimposed printing of a single recording medium, whereby two serially connected, first printer devices of each printer chain and serially connected second and third printer devices of the second printer chain are operated in common; and a single print mode wherein at least one of the printer devices is operated as a single printer.

16. The method according to claim 15 whereby a photoconductor exhibits a slightly higher speed relative to the recoding medium at least during transfer of the toner images from the photoconductor onto the recording medium.

* * * * *